United States Patent [19]
Sakurai et al.
[11] 4,317,637
[45] Mar. 2, 1982

[54] TYPEWRITER RIBBON INCLUDING A CORRECTION STRIP

[76] Inventors: Shubun Sakurai, 6-24 Matsusato-Otokoyama, Yawata-City, Kyoto Pref.; Hiroyuki Goda, 1-104 Kuisehonmachi, Amagasaki-City, Hyogo Pref., both of Japan

[21] Appl. No.: 103,723

[22] Filed: Dec. 14, 1979

[30] Foreign Application Priority Data

Dec. 18, 1978 [JP] Japan ..... 53-174523[U]
Dec. 18, 1978 [JP] Japan ..... 53-174524[U]

[51] Int. Cl.[3] ..... B41J 31/02
[52] U.S. Cl. ..... 400/240.1; 400/240.2; 400/241.1
[58] Field of Search ..... 400/240, 240.1, 240.2, 400/241.1, 697, 697.1, 702

[56] References Cited

U.S. PATENT DOCUMENTS

| | | | |
|---|---|---|---|
| 1,392,458 | 10/1921 | Stark | 400/240.2 |
| 2,255,104 | 9/1941 | Dixon | 400/240.2 |
| 2,728,439 | 12/1955 | Murphy et al. | 400/240.2 X |
| 3,114,447 | 12/1963 | Wolowitz | 400/240.2 X |
| 3,141,539 | 7/1964 | Wolowitz | 400/240.2 X |
| 3,143,200 | 8/1964 | Gutman | 400/240.2 X |
| 3,273,686 | 9/1966 | Ploeger, Jr. | 400/240.2 X |
| 3,274,039 | 9/1966 | Ploeger, Jr. | 400/240.1 X |
| 3,461,998 | 8/1969 | Ploeger, Jr. | 400/240.2 X |
| 3,752,291 | 8/1973 | Barouh et al. | 400/240.2 X |
| 3,825,104 | 7/1974 | Wolowitz | 400/240.2 X |
| 3,896,920 | 7/1975 | Barouh et al. | 400/240.2 X |
| 4,007,823 | 2/1977 | Barouh et al. | 400/240.1 |
| 4,113,392 | 9/1978 | Ploeger, Jr. | 400/240.1 |

FOREIGN PATENT DOCUMENTS

| | | | |
|---|---|---|---|
| 2207932 | 8/1973 | Fed. Rep. of Germany | 400/240 |
| 2256643 | 7/1975 | France | 400/240 |
| 961108 | 6/1964 | United Kingdom | 400/240.1 |

*Primary Examiner*—Ernest T. Wright, Jr.
*Attorney, Agent, or Firm*—Amster, Rothstein & Engelberg

[57] ABSTRACT

A typewriter ribbon includes a fiber texture base strip divided by a barrier filling into a black-inked portion and an ink-free portion, and a correction strip, having thereon a white transfer layer, fixedly attached to and substantially superimposed on the entire ink-free portion. Another typewriter ribbon includes a film-like base strip, a black-inked fiber texture strip fixedly attached at one edge thereof to one edge of the base strip by a fused joint to substantially superimpose an essential half of the base strip, and a correction strip, having thereon a white transfer layer, fixedly attached to the base strip to substantially superimpose the essential remaining half of the base strip.

2 Claims, 4 Drawing Figures

TYPEWRITER RIBBON INCLUDING A CORRECTION STRIP

BACKGROUND OF THE INVENTION

This invention relates, in general, to typewriter ribbons and, in particular, to composite typewriter ribbons including a transfer strip and a correction strip.

It has been known that the composite typewriter ribbon is convenient for correcting characters erroneously impressed on a sheet of paper with a correction strip capable of transferring covering-up material over the impressed character. Such typewriter ribbons are disclosed in U.S. Pat. Nos. 3,114,447 issued Dec. 17, 1963 to William H. Wolowitz; 3,141,539 issued July 21, 1964 to William H. Wolowitz; 3,143,200 issued Aug. 4, 1964 to Benjamin Gutman; 3,273,686 issued Sept. 20, 1966 to Walter Ploeger, Jr.; 3,274,039 issued Sept. 20, 1966 to Walter Ploeger, Jr.; 3,461,998 issued Aug. 19, 1969 to Walter Ploeger, Jr.; 3,752,291 issued Aug. 14, 1972 to Victor Barough, et al.; 3,825,104 issued July 23, 1974 to William H. Wolowitz; 3,896,920 issued July 29, 1975 to Victor Barough, et al.; and British Pat. No. 961,108 published June 17, 1964 to William H. Wolowitz.

SUMMARY OF THE INVENTION

The typewriter ribbon of the present invention comprises a base strip and a correction strip. The base strip is made of a fiber texture and has two longitudinally extending portions divided by a barrier filling. One of the two portions is impregnated with black-ink and the other is not impregnated with any ink. The correction strip includes a white transfer layer and is fixedly attached to the opposite face of the ink-free portion of the base strip with respect to a typing direction so that the correction strip is substantially superimposed on the entirety of the ink-free portion.

According to another aspect of the invention, the typewriter ribbon comprises a base strip, a black-inked strip made of a fiber texture, and correction strip. The black-inked strip is fixedly attached at one end thereof to one edge of the base strip by means of a fused joint provided along one edge of the typewriter ribbon to substantially superimpose an essential half of the base strip. The correction strip includes a white transfer layer, and is fixedly attached to the same face of the base strip as the black-inked strip. The correction strip is substantially superimposed on the essential remaining half of the base strip. The correction strip is preferably attached at one edge thereof to the other edge of the base strip by means of another fused joint provided along the other side of the typewriter ribbon. The correction strip may be attached to the base strip by means of an adhesive. Furthermore the correction strip is preferably composed of a material less resilient that the inked strip.

BRIEF DESCRIPTION OF THE DRAWING

The invention may be better understood when considered in view of the following detailed decriptions of preferred embodiments, taken with the accompanying drawing, in which.

Throughout the Figures, like reference numerals designate like or corresponding components.

DESCRIPTION OF THE PREFERRED EMBODIMENTS

Figure 1:
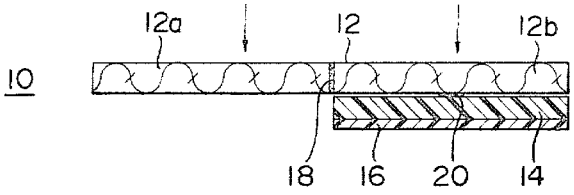
FIG. 1 is an enlarged cross-sectional view of a typewriter ribbon according to the present invention taken along a width of the ribbon.

Referring now to the drawing, a typewriter ribbon generally designated by reference numeral 10 is shown in FIG. 1 as one embodiment of the invention. The typewriter ribbon 10 includes a base strip 12 made of a fiber texture or cloth composed of a thermoplastic resin such as nylon, and a correction strip 14 with a white transfer layer 16 thereon. The base strip 12 is divided by the longitudinal line of the base strip 12 into two portions 12*a* and 12*b*, one portion 12*a* of which is impregnated with black ink, for example, and the other portion 12*b* of which is not impregnated with any ink. The longitudinal line may be centered in the base strip 12 and is provided with a barrier filling 18 in order to prevent the black ink impregnated in the black-inked portion 12*a* from entering into the ink-free portion 12*b*. The correction strip 14 is attached to the ink-free portion 12*b* and extends across a substantial width of the ink-free portion 12*b* in parallel therewith. It is to be noted that the correction strip 14 is attached to the opposite side of the typewriter ribbon 10 with respect to a typing direction shown by arrows in FIG. 1 and the white transfer layer 16 in the correction strip 14 faces a sheet of paper to be typed (not shown) when in use. The correction strip 14 may be made of a film composed of a thermoplastic resin or made of a thin paper. The fixed attachment of the correction strip 14 and the ink-free portion 12*b* is made by means of an adhesive 20 so that the entire width of the ink-free portion 12*b* is substantially superposed on the correction strip 14. It is also to be noted that in FIG. 1 the correction strip 14 is shown to be bonded to the ink-free portion 12*b* by means of the adhesive 20 only around the central portion thereof while they may be bonded to each other over their entire width.

Upon impressing the black-inked portion 12*a* of the base strip 12 from the typing direction shown by the arrows in FIG. 1, the black ink remains attached to a type body (not shown). However in accordance with the present invention, the white transfer layer 16 in the correction ribbon 14 is impressed through the ink-free porton 12*b* of the base strip 12, viewed from the typing direction shown by the arrows, and therefore the black ink remaining attached to the type body is absorbed by the ink-free portion 12*b* of the fiber texture forming the base strip 12. Thus any deposit of the white transfer layer 16 on the type face is avoided. Also, since the base strip 12 absorbs the ink, the ink-free portion 12*b* does not easily release the absorbed ink, resulting in a less ink stain of the white transfer layer 16 even in case of the typewriter ribbon 10 being taken up or a ribbon reel (not shown).

Figure 2:
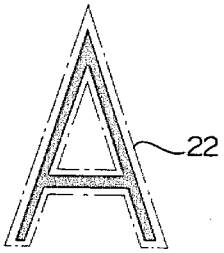
FIG. 2 shows enlarged configurations of typed characters impressed through a black-inked strip and a correction strip.

In correcting an error-typed black character A as illustrated in FIG. 2, since the white transfer layer 16 in the correction strip 14 is type-impressed by the same type body A through the ink-free portion 12*b* made of the fiber texture from the typing direction shown by the arrows in FIG. 1, the contour of the same white character A becomes obscure and therefore somewhat larger than the contour of the black character A, as shown by a dot-dash line 22 in FIG. 2, resulting in an almost complete correction.

Figure 3:
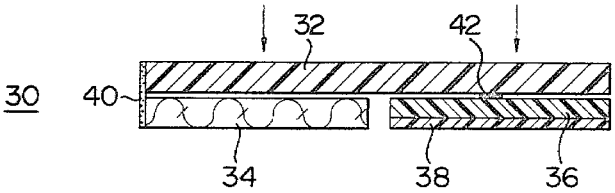
FIG. 3 is an enlarged cross-sectional view of another embodimet of a typewriter ribbon of the present invention.

Referring to FIG. 3, another embodiment of the invention is shown in which a typewriter ribbon generally designated by a reference numeral 30 includes a film layer 32 serving as a base strip of the typewriter ribbon 30, a typing strip 34 made of a fiber texture composed of a thermoplastic resin such as nylon and impregnated with a black ink, and a correction strip 35 having a white transfer layer 38. The width of the film layer 32 is as much as the combined widths of the typing strip 34 and the correction strip 36 to essentially superimpose one face of the film layer 32, as shown in FIG. 3. The film layer 32 is formed of a thermoplastic resin such as nylon, and coupled with the typing strip 34 to fix it, as substantially superimposed on an essential half of the film layer 32, by means of a fused joint 40 provided along one longitudinal edge of the typewriter ribbon 30 so that one edge of the film layer 32 may be joined to one edge of the typing strip 34. The fused joint 40 is usually made by the use of conventional techniques such a ultra sonic waves, high frequency waves, or heat. The correction strip 36 may be of a relatively less flexible material such as a sheet of paper or of a thermoplastic resin such as nylon. Fixing between the film layer or base strip 32 and the correction strip 36 is achieved by an adhesive 42 provided around the central portion of the correction strip 36, thereby substantially superimposing the correction strip 36 on the essential remaining half of the base strip 32, as shown in FIG. 3. It is to be noted that the adhesive 42 may be provided over the entire width of the correction strip 36 facing the film layer 32.

Figure 4:
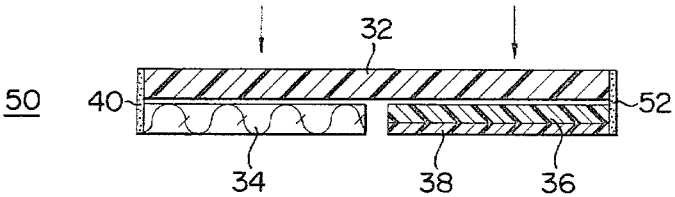
FIG. 4 is an enlarged cross-sectional view of a modified form of the typewriter ribbon of FIG. 3.

FIG. 4 shows a modified form of the embodiment of FIG. 3. In this typewriter ribbon generally designated by reference numeral 50, the correction strip 36 is fixed to the film layer 32 now by means of another fused joint 52 provided along the other longitudinal edge of the typewriter ribbon 50 so that the correction strip 36 is substantially superimposed on the film layer 32 with one edge of the correction strip 36 being joined with the other edge of the film layer 32. This fused joint 52 is made by the use of similar techniques of those described hereinbefore for the fused joint 40. Other components and the arrangement thereof are the same as in FIG. 3.

It is to be noted that which embodiment of FIG. 3 or FIG. 4 should be used for fixing the film layer 32 with the correction strip 36 depends upon the quality of the latter.

Also in accordance with this latter embodiment of the invention, because of the presence of the film layer 32 on the typing black-inked strip 34 as well as the correction strip 36, viewed from typing directions shown by arrows in FIGS. 3 and 4, it is possible to prevent a type body (not shown) from being stained or deposited with the black ink. Furthermore, the white transfer layer 38 in the correction strip 36 is not stained because it has no direct contact with the black-inked strip 34 even when taking up the typewriter ribbon 30 or 50. Therefore the typing black-inked strip 34 has an increased durability.

With regard to the configuration of the white correction, the same in FIG. 2 applies to the embodiment shown in FIGS. 3 and 4. Thus error-typed black characters can be satisfactorily corrected or obliterated by using the correction strip 36 with the white transfer layer 38, thereby enabling the next correct typing to be readied.

What we claim is:

1. A typewriter ribbon comprising:

a base strip made of a fiber texture and having two portions longitudinally divided by a barrier filling, one of which being black-inked and the other of which being ink-free, each of said portions being of substantially the same thickness and composed of a thermoplastic resin, a correction strip, including a white transfer layer, fixedly attached to the opposite face of said ink-free portion of said base strip with respect to a typing direction so that said correction strip is substantially superimposed on the entirety of said ink-free portion, and said correction strip is attached to said ink-free portion by means of an adhesive disposed therebetween and around the central portion thereof.

2. A typewriter ribbon comprising:

a film-like base strip, a black-inked fiber texture strip fixedly attached at one edge thereof to said base strip by means of a fused joint provided along one longitudinal edge of said typewriter ribbon to be substantially superimposed on approximately half of said base strip, a correction strip, includng a white transfer layer, fixedly attached to the same face of said base strip as said black-inked strip and to the opposite face of said base strip with respect to a typing direction to be substantially superimposed on approximately the remaining half of said base strip, said correction strip is attached at one edge thereof to the other edge of said base strip by means of another fused joint provided along the other longitudinal edge of said typewriter ribbon, and said base strip and said correction strip are both composed of a thermoplastic resin.

* * * * *